US011783987B2

(12) United States Patent
Zhang et al.

(10) Patent No.: US 11,783,987 B2
(45) Date of Patent: Oct. 10, 2023

(54) TRANSFORMER AND POWER MODULE INCLUDING THE SAME

(71) Applicant: Delta Electronics (Shanghai) CO., LTD, Shanghai (CN)

(72) Inventors: Quanliang Zhang, Shanghai (CN); Shizhong Guo, Shanghai (CN); Min Zhou, Shanghai (CN); Lin Lan, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 450 days.

(21) Appl. No.: 17/011,135

(22) Filed: Sep. 3, 2020

(65) Prior Publication Data

US 2021/0134511 A1 May 6, 2021

(30) Foreign Application Priority Data

Oct. 31, 2019 (CN) ..... 201911056698.8

(51) Int. Cl.
*H01F 27/08* (2006.01)
*H01F 27/32* (2006.01)

(52) U.S. Cl.
CPC ..... *H01F 27/085* (2013.01); *H01F 27/327* (2013.01); *H01F 2027/329* (2013.01)

(58) Field of Classification Search
CPC ..... H01F 27/085; H01F 2027/329
USPC ..... 336/90
See application file for complete search history.

(56) References Cited

U.S. PATENT DOCUMENTS 3,851,287 A * 11/1974 Miller ..... H01F 27/36 336/84 R
4,464,544 A * 8/1984 Klein ..... H01F 27/36 381/167
4,521,954 A 6/1985 Rademaker et al.
4,660,014 A * 4/1987 Wenaas ..... H01F 27/06 336/92

(Continued)

FOREIGN PATENT DOCUMENTS

CN 101710793 A 5/2010
CN 102158057 A 8/2011

(Continued)

OTHER PUBLICATIONS

The Extended European Search Report dated Mar. 19, 2021 from EP patent application No. 20204365.9.

(Continued)

*Primary Examiner* — Mang Tin Bik Lian
*Assistant Examiner* — Joselito S. Baisa
(74) *Attorney, Agent, or Firm* — Qinghong Xu

(57) ABSTRACT

A transformer includes an insulation member, a high voltage part, and a low voltage part, the insulation member includes a first insulator, a second insulator, and a reference plane, the high voltage part is disposed on a first side of the reference plane, the low voltage part is disposed on a second side of the reference plane, the first insulator is disposed on the reference plane, at least a portion of the second insulator is located around the high voltage part, at least one air passage is formed by the insulation member, and at least a portion of the air passage is located within a height of the high voltage part in a normal direction of the reference plane.

18 Claims, 14 Drawing Sheets

(56) References Cited

U.S. PATENT DOCUMENTS

| | | | | | |
|---|---|---|---|---|---|
| 5,025,489 | A | * | 6/1991 | Yamaguchi | H05B 6/129 361/818 |
| 5,272,459 | A | * | 12/1993 | Geery | H01F 5/04 336/107 |
| 5,550,452 | A | * | 8/1996 | Shirai | H02J 50/12 320/108 |
| 5,701,244 | A | * | 12/1997 | Emmert | H01F 27/02 363/146 |
| 2003/0213789 | A1 | | 11/2003 | Andersen | |
| 2005/0168942 | A1 | | 8/2005 | Steinbrecher | |
| 2008/0037219 | A1 | | 2/2008 | Chen et al. | |
| 2009/0159569 | A1 | | 6/2009 | Kurogi | |
| 2012/0126617 | A1 | | 5/2012 | Peng | |
| 2015/0223366 | A1 | | 8/2015 | Horiuchi et al. | |
| 2015/0245537 | A1 | | 8/2015 | Sakuma et al. | |
| 2015/0348694 | A1 | | 12/2015 | Sakuma et al. | |
| 2016/0037677 | A1 | | 2/2016 | Yamanaka et al. | |
| 2018/0323022 | A1 | | 11/2018 | Skibinski et al. | |
| 2020/0158354 | A1 | | 5/2020 | Kurokawa et al. | |
| 2020/0343033 | A1 | | 10/2020 | Ettl | |
| 2020/0350830 | A1 | | 11/2020 | Hano et al. | |
| 2021/0136944 | A1 | | 5/2021 | Lan et al. | |
| 2021/0167430 | A1 | | 6/2021 | Silha et al. | |
| 2021/0219458 | A1 | | 7/2021 | Yan et al. | |

FOREIGN PATENT DOCUMENTS

| | | | | | |
|---|---|---|---|---|---|
| CN | 202840910 | U | | 3/2013 | |
| CN | 203251558 | U | | 10/2013 | |
| CN | 203377798 | U | | 1/2014 | |
| CN | 104052292 | A | | 9/2014 | |
| CN | 204578343 | U | | 8/2015 | |
| CN | 205050689 | U | | 2/2016 | |
| CN | 105810406 | A | | 7/2016 | |
| CN | 205645692 | U | * | 10/2016 | |
| CN | 106098316 | A | | 11/2016 | |
| CN | 106159537 | A | | 11/2016 | |
| CN | 106953502 | A | | 7/2017 | |
| CN | 107666235 | A | | 2/2018 | |
| CN | 207638544 | U | | 7/2018 | |
| CN | 207852449 | U | | 9/2018 | |
| CN | 207852449 | U | * | 9/2018 | |
| CN | 208027854 | U | | 10/2018 | |
| CN | 108831716 | A | | 11/2018 | |
| CN | 109861557 | A | | 6/2019 | |
| CN | 209267423 | U | | 8/2019 | |
| CN | 108831716 | B | * | 11/2019 | H01F 27/2828 |
| CN | 209571814 | U | * | 11/2019 | |
| EP | 0794098 | A1 | | 9/1997 | |
| EP | 1220574 | A2 | | 7/2002 | |
| EP | 2487697 | A1 | | 8/2012 | |
| JP | 2016082602 | A | | 5/2016 | |
| JP | 2021100055 | A | * | 7/2021 | |
| TW | 201113913 | A | | 4/2011 | |
| WO | 2004055965 | A1 | | 7/2004 | |
| WO | WO-2020182835 | A1 | * | 9/2020 | H01F 27/025 |

OTHER PUBLICATIONS

"Externally-fed auxiliary power supply of MMC converter cells".
The 1st Office Action dated Oct. 11, 2021 for CN patent application No. 201911056698.8.
The Notice of Allowance dated Oct. 11, 2021 for CN patent application No. 201911055495.7.
The 1st Office Action dated Dec. 1, 2021 for CN patent application No. 201911056710.5.
Non-Final Rejection dated Apr. 8, 2022 of U.S. Appl. No. 17/037,927.
Non-Final Rejection dated Apr. 8, 2022 of U.S. Appl. No. 17/077,381.

* cited by examiner

TRANSFORMER AND POWER MODULE INCLUDING THE SAME

CROSS REFERENCE

This application is based upon and claims priority to Chinese Patent Application No. 201911056698.8, filed on Oct. 31, 2019, the entire contents of which are incorporated herein by reference.

TECHNICAL FIELD

The present disclosure relates to the field of power electronics technology, and in particular, to a transformer and a power module including the same.

BACKGROUND

A distribution network in the art begins to adopt new technologies, that is, a power electronic transformer (PET) to replace a power frequency distribution transformer to compensate for various shortcomings thereof and to achieve the distribution network of high power density, miniaturization, high efficiency, and intelligence. One of the core components in PET is a high-frequency and high-voltage transformer, which is responsible for energy conversion and insulation isolation of a high voltage side and a low voltage side.

Since the high-frequency and high-voltage transformer is responsible for the isolation between high and low voltages, insulation is the first major issue it faces. The existing common insulation method is to coat with a solid insulation material. At this point, heat dissipation often becomes a bottleneck of the high-frequency and high-voltage transformer.

SUMMARY

According to a first aspect of the present disclosure, there is provided a transformer, including:

an insulation member, including a first insulator, a second insulator, and a reference plane;

a high voltage part, disposed on a first side of the reference plane; and a low voltage part, disposed on a second side of the reference plane;

wherein the first insulator is disposed on the reference plane, at least a portion of the second insulator is located around the high voltage part, at least one air passage is formed by the insulation member, and at least a portion of the air passage is located within a height of the high voltage part in a normal direction of the reference plane.

In an embodiment of the present disclosure, a first conductive part is disposed on the insulation member, and the first conductive part is located on the first side of the reference plane, and is made of a semi-conductive material.

In an embodiment of the present disclosure, the first conductive part is disposed between the first insulator and the high voltage part.

In an embodiment of the present disclosure, a projection of the high voltage part on the reference plane is located within a projection of the first conductive part on the reference plane.

In an embodiment of the present disclosure, a second conductive part is disposed on the insulation member, and is located on the first side of the reference plane, and a conductivity of the second conductive part is lower than that of the first conductive part.

In an embodiment of the present disclosure, the second conductive part is disposed along a circumferential outer edge of the first conductive part.

In an embodiment of the present disclosure, the second conductive part is made of a semi-conductive material.

In an embodiment of the present disclosure, the second conductive part is made of a metal material.

In an embodiment of the present disclosure, at least a portion of the second conductive part is buried in the first insulator.

In an embodiment of the present disclosure, a third conductive part is disposed on the insulation member, and the third conductive part is located on the second side of the reference plane and is made of a semi-conductive material.

In an embodiment of the present disclosure, a fourth conductive part is disposed on the insulation member, and is located on the second side of the reference plane, and a conductivity of the fourth conductive part is lower than that of the third conductive part.

In an embodiment of the present disclosure, the insulation member includes two second insulators which are disposed oppositely and connected to two ends of the first insulator, respectively, and the air passage is formed between the first insulator and the two second insulators.

In an embodiment of the present disclosure, the insulation member further includes a third insulator which is disposed opposite to the first insulator and connected to the two second insulators, and the air passage is formed between the first insulator, the two second insulators, and the third insulator.

In an embodiment of the present disclosure, the insulation member further includes a third insulator which is connected to the first insulator and the two second insulators.

In an embodiment of the present disclosure, a preset angle is formed between the third insulator and the first insulator, and the preset angle is ranged from 90° to 270°.

In an embodiment of the present disclosure, the high voltage part includes a plurality of high voltage parts and the low voltage part includes a plurality of low voltage parts, and the plurality of high voltage parts and the plurality of low voltage parts are disposed in one-to-one correspondence.

In an embodiment of the present disclosure, the high voltage part includes a first magnetic core and a first winding disposed on the first magnetic core, and the low voltage part includes a second magnetic core and a second winding disposed on the second magnetic core.

According to a second aspect of the present disclosure, there is provided a power module including the above-mentioned transformer, a high voltage power unit, and a low voltage power unit, the high voltage power unit is electrically connected to the high voltage part of the transformer, and the low voltage power unit is electrically connected to the low voltage part of the transformer.

BRIEF DESCRIPTION OF THE DRAWINGS

Various objects, features and advantages of the present disclosure will become more apparent from the following detailed description of the preferred embodiments of the present disclosure in conjunction with the accompanying drawings. The drawings are merely schematic representations of the present disclosure and are not necessarily drawn to scale. The same reference numerals in the drawings denote the same or similar parts. In the drawings.

LIST OF REFERENCE NUMERALS

Figure 1:
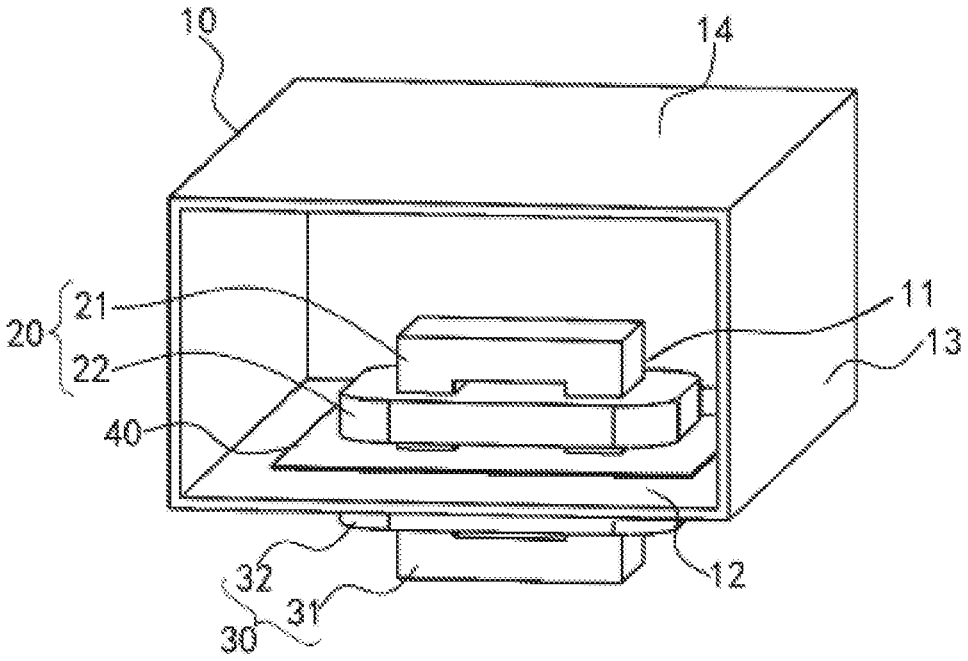
FIG. 1 is a schematic structural diagram showing a transformer from a first perspective according to a first exemplary embodiment.

10, insulation member; 11, first air passage; 12, first insulator; 13, second insulator; 14, third insulator; 15, second air passage; 16, third insulator; 20, high voltage part; 21, first magnetic core; 22, first winding; 30, low voltage part; 31, second magnetic core; 32, second winding; 40, first conductive part; 50, second conductive part; 60, third conductive part.

DETAILED DESCRIPTION

Typical embodiments embodying the features and advantages of the present disclosure will be described in detail in the following description. It should be understood that the present disclosure can have various changes on the basis of different embodiments without departing from the scope of the present disclosure, and the description and drawings therein are provided substantially for the purpose of illustration, rather than limiting the present disclosure.

In the following description of different exemplary embodiments of the present disclosure, reference is made to the accompanying drawings, which form a part of the present disclosure, and various exemplary structures, systems and steps are shown by way of example, which may implement various aspects of the present disclosure. It should be understood that other specific schemes of components, structures, exemplary devices, systems, and steps may be used, and structural and functional modifications may be made without departing from the scope of the present disclosure. Moreover, although the terms "over", "between", "within", and the like may be used in this specification to describe various exemplary features and elements of the present disclosure, these terms are used herein for convenience only, such as based on the orientations of examples in the drawings. Nothing in this specification should be understood as requiring a particular three-dimensional orientation of the structure to fall within the scope of the present disclosure.

Embodiments of the present disclosure provide a transformer. Referring to FIG. 1 to FIG. 14, the transformer includes: an insulation member 10 including a first insulator 12, a second insulator 13, and a reference plane; a high voltage part 20, disposed on a first side of the reference plane; and a low voltage part 30, disposed on a second side of the reference plane, the first insulator 12 is disposed on the reference plane, at least a portion of the second insulator 13 is located around the high voltage part 20, at least one air passage is formed by the insulation member 10, and at least a portion of the air passage is located within a height of the high voltage part 20 in a normal direction of the reference plane.

In the transformer according to an embodiment of the present disclosure, an insulation between the high voltage part 20 and the low voltage part 30 is realized through the insulation member 10, and effective heat dissipation of the high voltage part 20 is realized by disposing the high voltage part 20 in the air passage. Compared with the coating insulation method used in the art, the transformer structure of the present disclosure avoids complete coating of the high voltage part 20, that is, a heat dissipation ability of its own is not hindered, and the heat generated by the high voltage part 20 is taken away in time by air flow in the air passage structure of the insulation member 10.

In an embodiment, the insulation member 10 includes the first insulator 12, the second insulator 13, and the reference plane. The first insulator 12 is disposed on the reference plane, and the high voltage part 20 and the low voltage part 30 are respectively disposed on the first side and the second side of the reference plane, that is, the high voltage part 20 and the low voltage part 30 are located on the two sides of the first insulator 12, respectively. Here, the high voltage part 20 and the low voltage part 30 may be disposed directly on the first insulator 12, or they may not be in contact with the first insulator 12.

Figure 11:
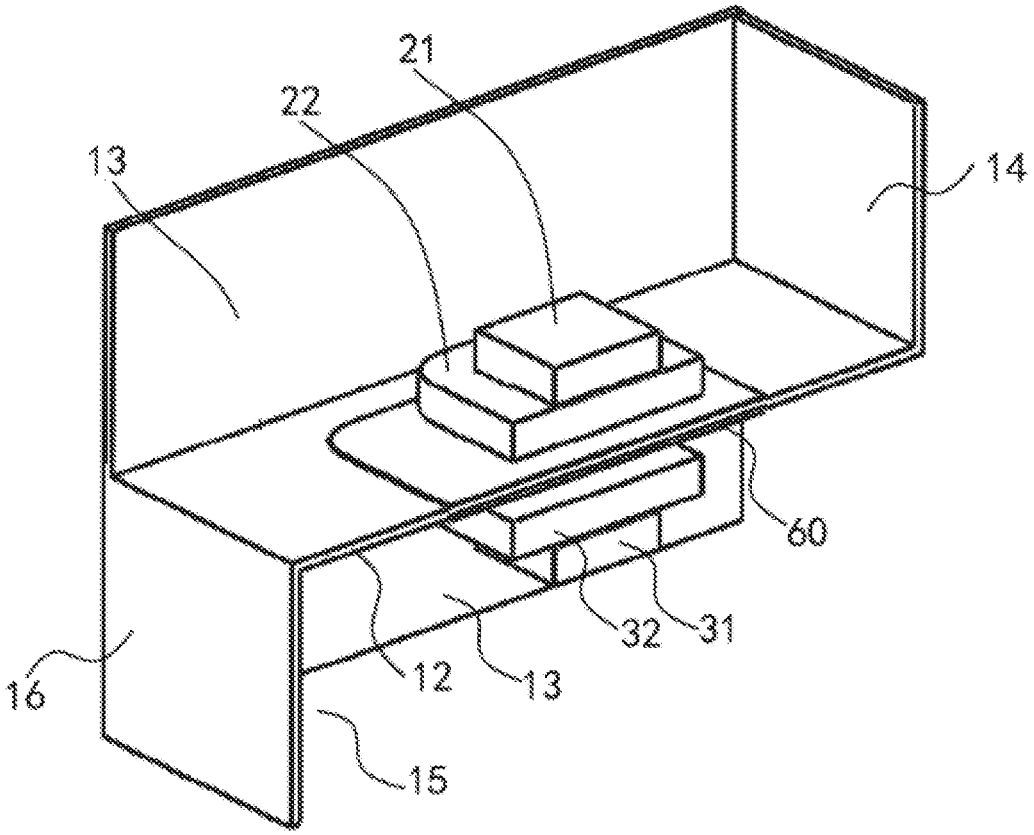
FIG. 11 is a schematic diagram showing a cross-sectional structure of the transformer according to the sixth exemplary embodiment.
Figure 13:
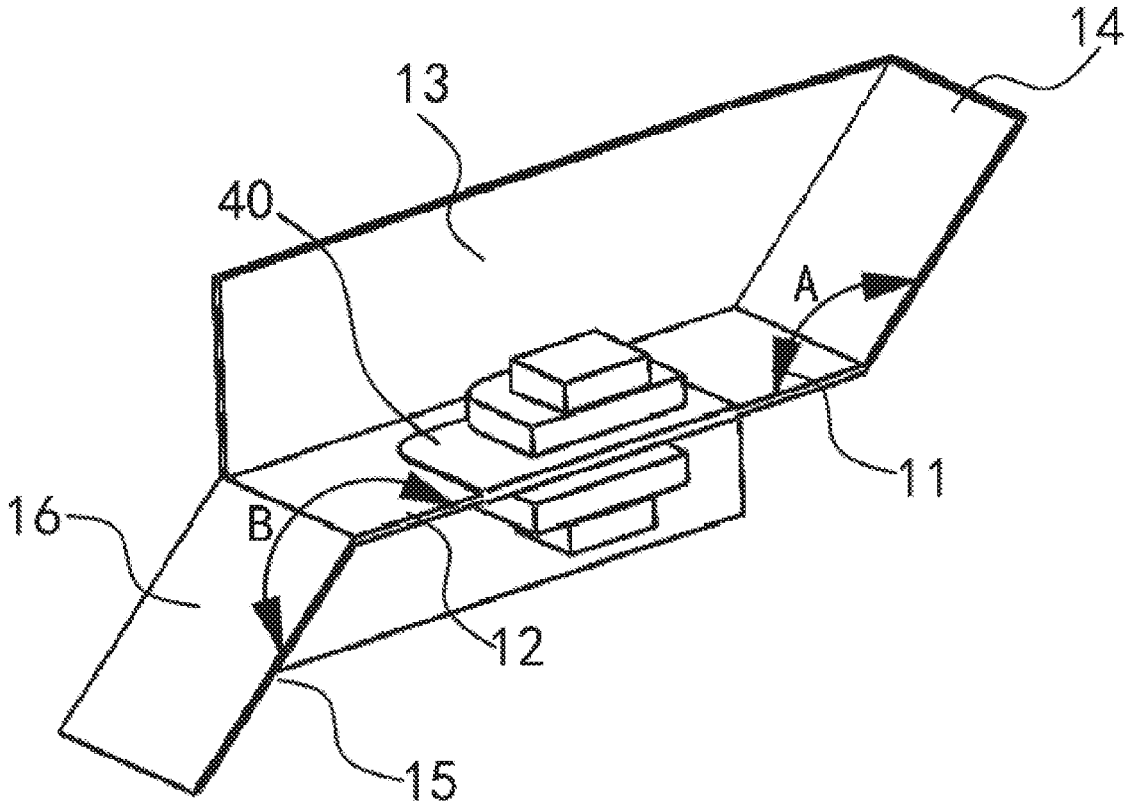
FIG. 13 is a schematic diagram showing a cross-sectional structure of the transformer according to the seventh exemplary embodiment.

In an embodiment, at least a portion of the air passage is located within the height of the high voltage part 20 in the normal direction of the reference plane, that is, the high voltage part 20 is located inside the air passage. Here, the number of the air passages may be one, that is, the first air passage 11 which is located on the first side of the reference plane, and the high voltage part 20 is located in the first air passage 11. The number of the air passages may be two, as shown in FIG. 11 or 13, that is, the two air passages are the first air passage 11 and the second air passage 15, and the first air passage 11 and the second air passage 15 are respectively located on the first and second sides of the reference plane. The high voltage part 20 is located in the first air passage 11, and the low voltage part 30 is located in the second air passage 15. When the insulation member 10 has the first air passage 11 and the second air passage 15, not only the heat dissipation effect is increased, but also a creepage distance along a surface of the insulation member 10 is increased.

Figure 2:
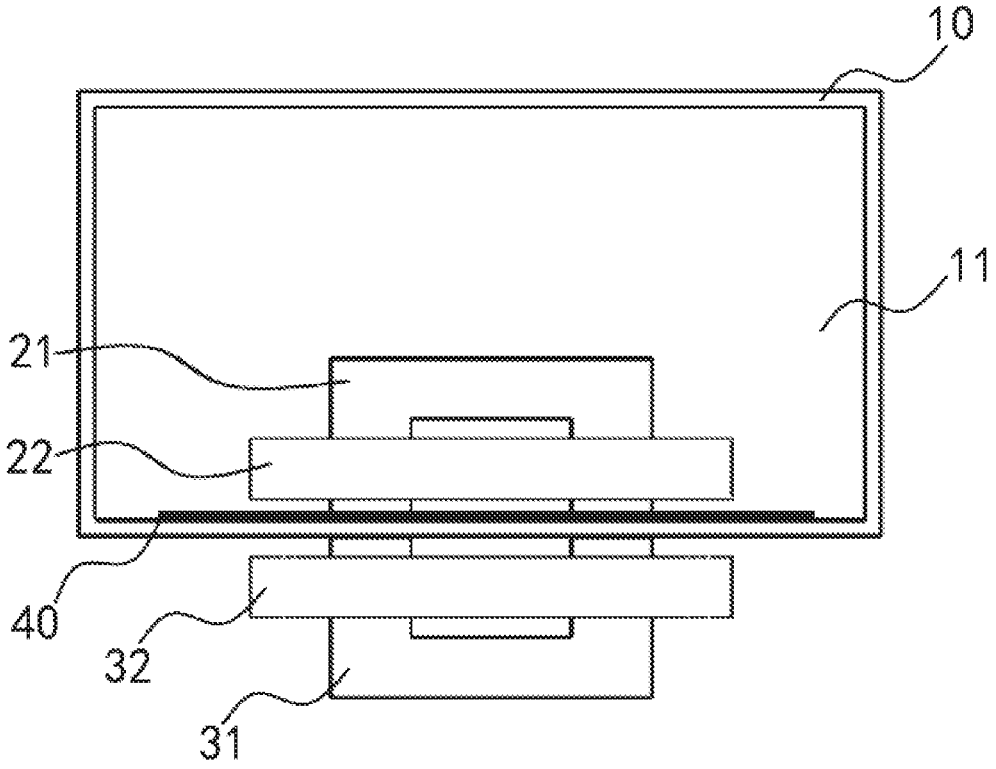
FIG. 2 is a schematic structural diagram showing a transformer from a second perspective according to the first exemplary embodiment.

As shown in FIG. 1 and FIG. 2, a first conductive part 40 is disposed on the insulation member 10, and the first conductive part 40 is located on the first side of the reference plane. The first conductive part 40 is made of a semi-conductive material.

In an embodiment, the first conductive part 40 made of the semi-conductive material is disposed on the insulation member 10, so that an electric field generated by the high voltage part 20 is more evenly distributed on the insulation member 10.

In an embodiment, the first conductive part 40 is a shielding layer which is adhered to the surface of the insulation member 10 by spraying, plating, coating, or the like, and they are bonded with each other without a gap therebetween. The requirement of high voltage insulation is met by using the insulator with the shielding layer so that the electric field is more even, and an insulation thickness on the winding surface can be reduced.

In an embodiment, the high voltage part 20 includes a first magnetic core 21 and a first winding 22 disposed on the first magnetic core 21, and the low voltage part 30 includes a second magnetic core 31 and a second winding 32 disposed on the second magnetic core 31. The first magnetic core 21 and the first winding 22 are electrically isolated from the second magnetic core 31 and the second winding 32 by the insulation member 10. With respect to the insulation between the first magnetic core 21 and the first winding 22 itself, it only needs to meet the requirement of an inter-turn voltage or an inter-layer voltage of the winding. Compared with the conventional vacuum casting solid insulation of the high voltage coil which is used for meeting the requirement for the insulation between the high and low voltages, the insulation thickness on the winding surface in this embodiment can be greatly reduced, for example, by 20 times, and a thermal resistance caused by the insulating material is thus reduced by 20 times, which improves the heat dissipation.

In an embodiment, the first conductive part 40 is disposed between the first insulator 12 and the high voltage part 20. With this arrangement, the electric field generated by the high voltage part 20 is evenly distributed on the first insulator 12 through the first conductive part 40.

In an embodiment, a projection of the high voltage part 20 on the reference plane is located within a projection of the first conductive part 40 on the reference plane. The electric field generated at the edge of the high voltage part 20 can also be evenly distributed by the first conductive part 40 located at the edge of the high voltage part 20, so as to improve the uniformity of the electric field as much as possible and avoid partial discharge.

As shown in FIG. 3 to FIG. 7, a second conductive part 50 is disposed on the insulation member 10, and the second conductive part 50 is located on the first side of the reference plane and has a conductivity lower than that of the first conductive part 40.

In an embodiment, the second conductive part 50 and the first conductive part 40 are both located on the first side of the reference plane, and the electric field generated by the high voltage part 20 is evenly distributed by the combined action of the second conductive part 50 and the first conductive part 40.

In an embodiment, the first conductive part 40 and the second conductive part 50 are both disposed on the first insulator 12, the second conductive part 50 is in contact with the first conductive part 40, and the conductivity of the second conductive part 50 is lower than that of the first conductive part 40.

In an embodiment, the second conductive part 50 is disposed along the circumferential outer edge of the first conductive part 40, so that the electric field accumulated on the circumferential outer edge of the first conductive part 40 can be further homogenized, and the partial discharge on the edge of the first conductive part 40 can be avoided.

Figure 3:
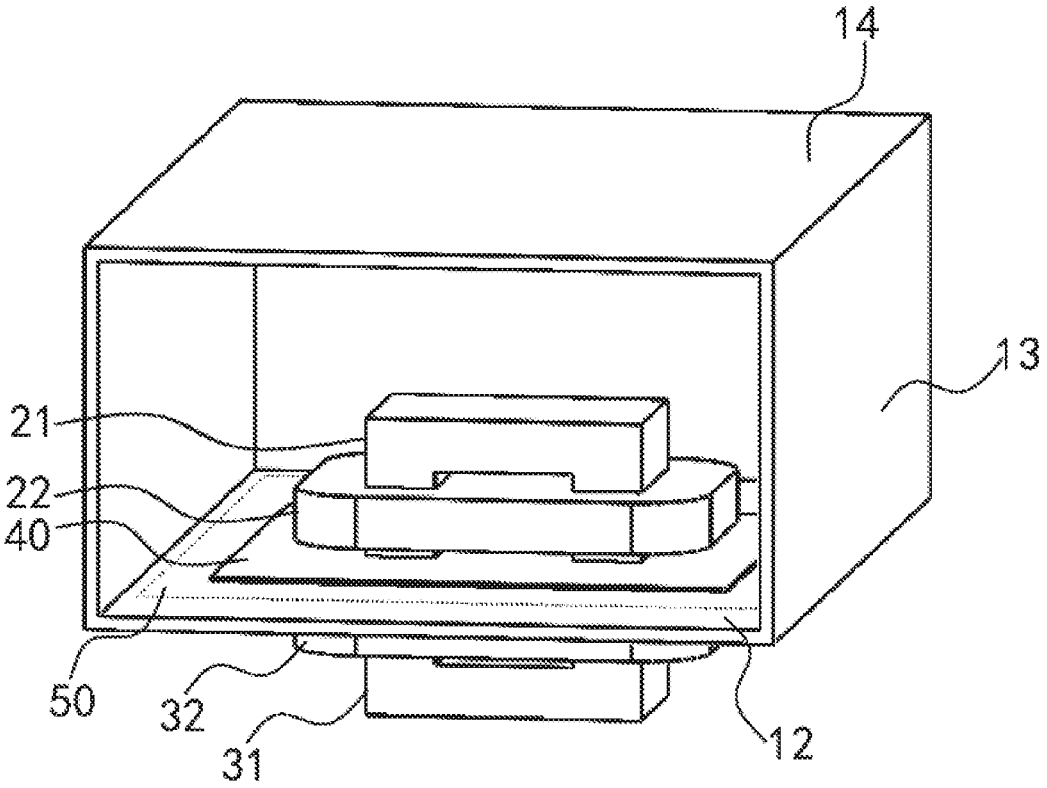
FIG. 3 is a schematic structural diagram showing a transformer from a first perspective according to a second exemplary embodiment.
Figure 4:
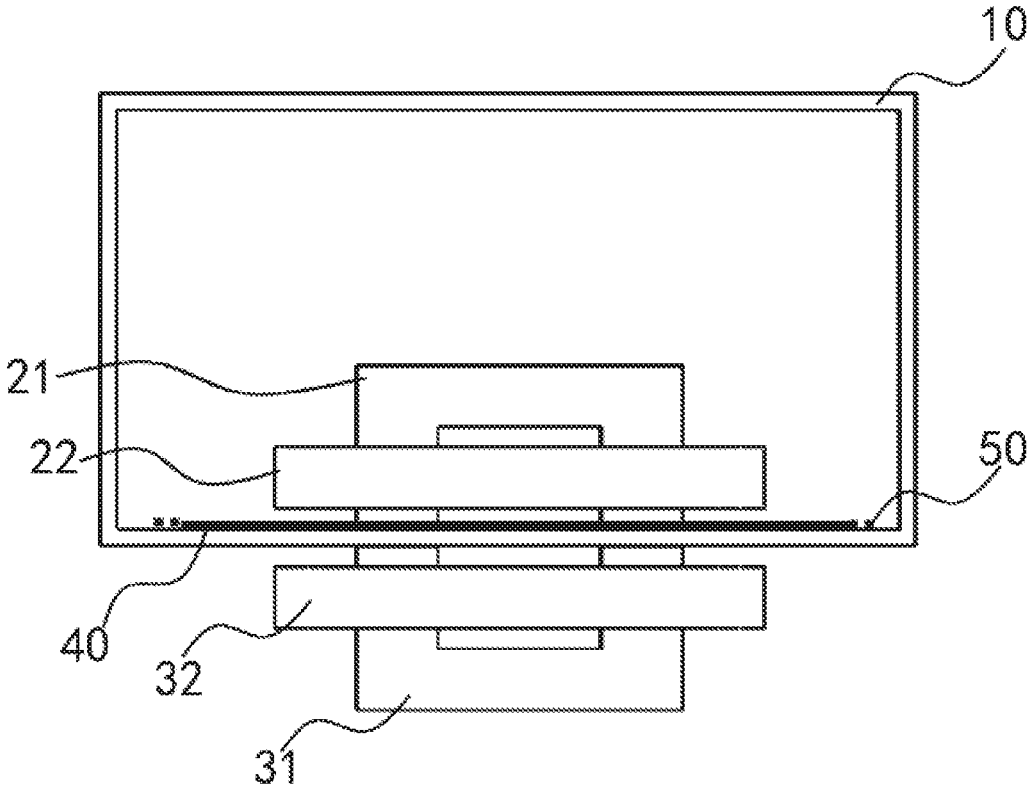
FIG. 4 is a schematic structural diagram showing a transformer from a second perspective according to the second exemplary embodiment.

As shown in FIGS. 3 and 4, the second conductive part 50 is made of a semi-conductive material, and is disposed on the first insulator 12 by coating or spraying and is located around the first conductive part 40.

In an embodiment, as shown in FIGS. 3 and 4, the second conductive part 50 is of a semi-conductive adhesive.

Figure 5:
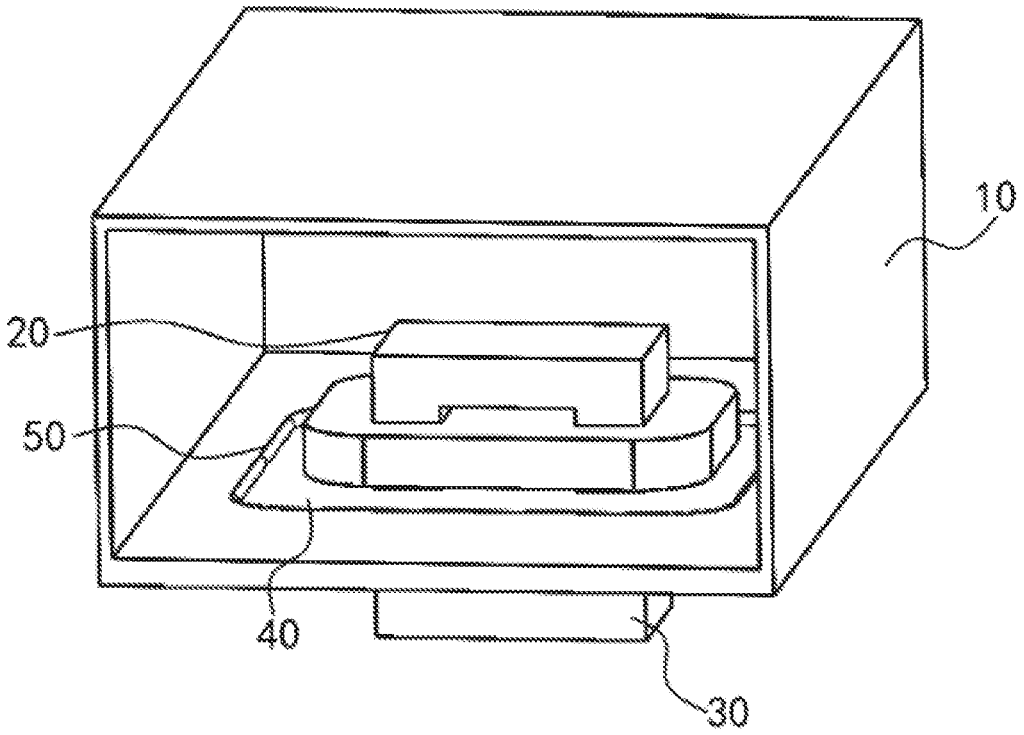
FIG. 5 is a schematic structural diagram showing a transformer according to a third exemplary embodiment.
Figure 6:
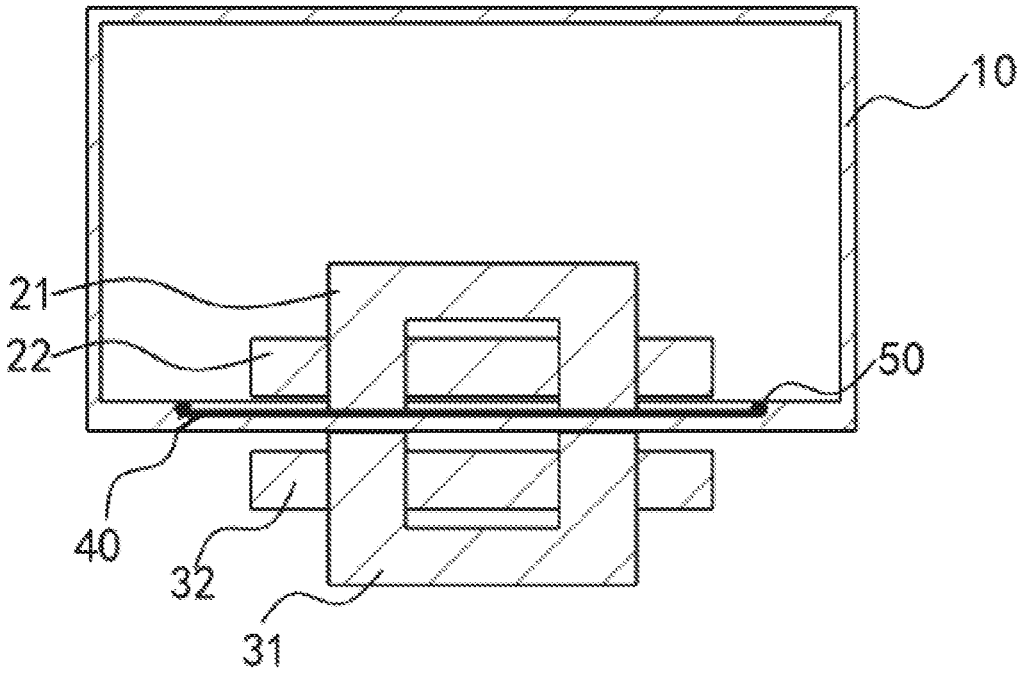
FIG. 6 is a schematic diagram showing a cross-sectional structure of the transformer according to the third exemplary embodiment.
Figure 7:
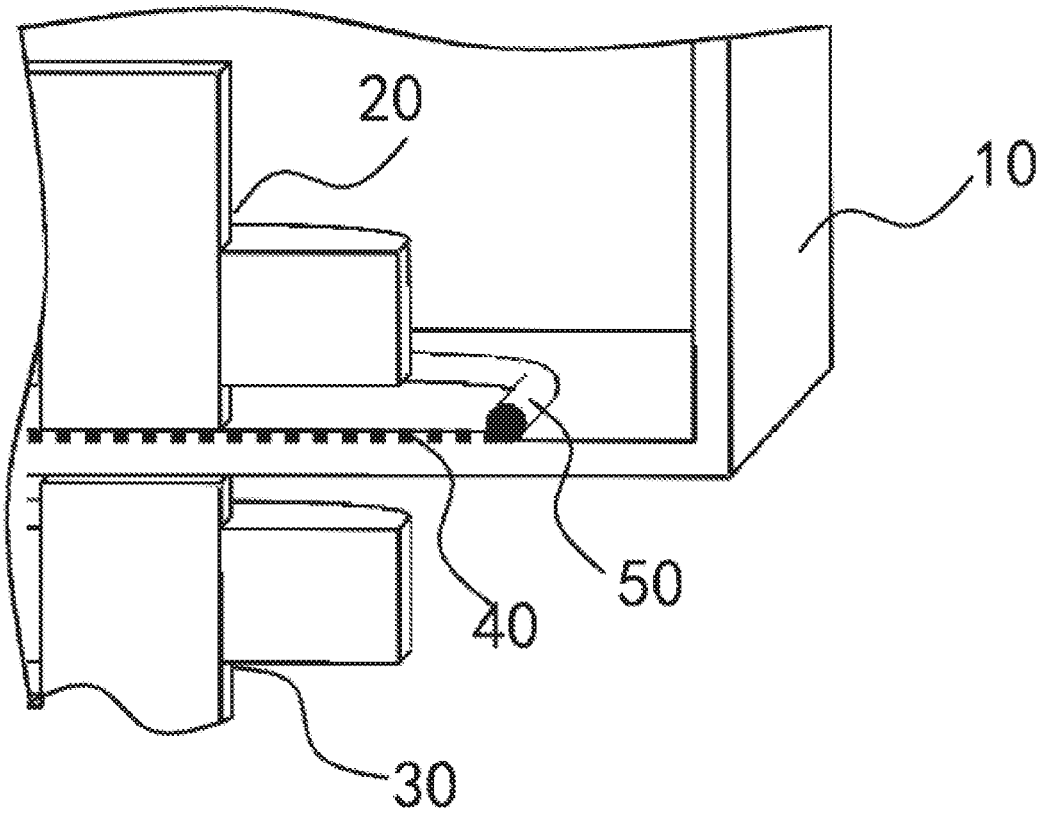
FIG. 7 is a schematic diagram showing a partially enlarged structure of a transformer according to a fourth exemplary embodiment.
Figure 8:
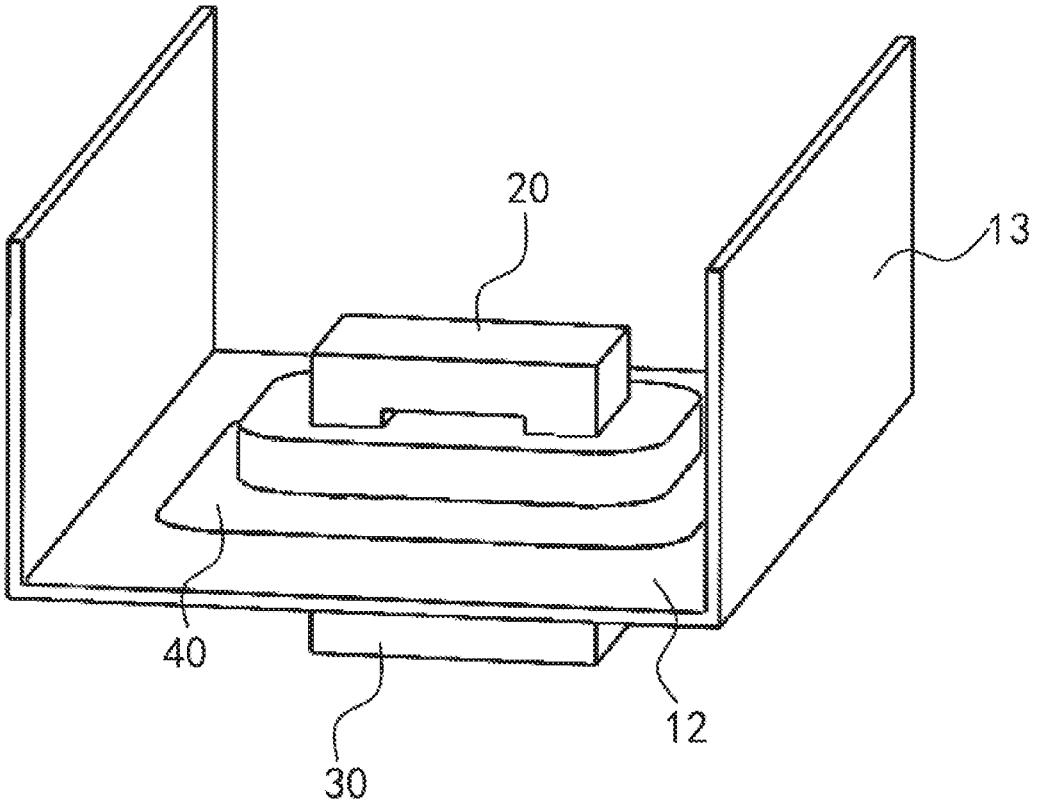
FIG. 8 is a schematic structural diagram showing a transformer from a first perspective according to a fifth exemplary embodiment.

In an embodiment, as shown in FIGS. 5 to 7, the second conductive part 50 is made of a metal material. The second conductive part 50 made of the metal material is located at the circumferential outer edge of the first conductive part 40 and is in contact with the first conductive part 40, so that the electric field around the edge of the first conductive part 40 can be more even, and the partial discharge on the edge of the first conductive part 40 can be avoided.

In an embodiment, the second conductive part 50 made of the metal material has an annular structure and is at least partially buried in the first insulator 12. In an embodiment, as shown in FIG. 7, the second conductive part 50 may be directly disposed on the surface of the first insulator 12, that is, it may not be buried in the first insulator 12, and it is only required to be in contact with the circumferential edge of the first conductive part 40.

As shown in FIG. 11, a third conductive part 60 is disposed on the insulation member 10, and the third conductive part 60 is located on the second side of the reference plane. The third conductive part 60 is made of a semi-conductive material.

In an embodiment, the third conductive part 60 is located on the second side of the reference plane, and the electric field generated by the low voltage part 30 is evenly distributed to the insulation member 10 by the third conductive part 60.

In an embodiment, the third conductive part 60 is a shielding layer which is adhered to the surface of the insulation member 10 by spraying, plating, coating, or the like, and they are bonded with each other without a gap therebetween. The insulation requirement is met by using the insulator with the shielding layer so that an interface structure between the insulator and the conductor is simple, the electric field is more uniform, and the insulation thickness can be reduced.

In an embodiment, the third conductive part 60 is disposed between the low voltage part 30 and the first insulator 12, and a projection of the low voltage part 30 on the reference plane is located within a projection of the third conductive part 60 on the reference plane.

In an embodiment, the first conductive part 40 is located on the first side of the reference plane, and the third conductive part 60 is located on the second side of the reference plane. The high voltage part 20 includes the first magnetic core 21 and the first winding 22 disposed on the first magnetic core 21, and the low voltage part 30 includes the second magnetic core 31 and the second winding 32 disposed on the second magnetic core 31. The first conductive part 40 is in contact with the first magnetic core 21, and the third conductive part 60 is in contact with the second magnetic core 31. The first magnetic core 21 and the first winding 22 are electrically isolated from the second magnetic core 31 and the second winding 32 by the insulation member 10.

In an embodiment, a fourth conductive part is disposed on the insulation member 10, and the fourth conductive part is located on the second side of the reference plane. The conductivity of the fourth conductive part is lower than that of the third conductive part 60. The fourth conductive part is in contact with the third conductive part 60 and is located on the circumferential outer edge of the third conductive part 60, so that the electric field accumulated on the circumferential outer edge of the third conductive part 60 can be further homogenized, and the partial discharge of the edge of the third conductive part 60 can be avoided.

In an embodiment, the fourth conductive part is made of a semi-conductive material or a metal material.

In an embodiment, the fourth conductive part is of a semi-conductive adhesive or a grading ring. For specific setting manners of the fourth conductive part, reference can be made to that of the second conductive part 50.

With respect to a specific structure of the insulation member 10, the insulation member 10 includes two second insulators 13 which are oppositely disposed and connected to two ends of the first insulator 12, respectively. The air passage is formed between the first insulator 12 and the two second insulators 13.

In an embodiment, as shown in FIG. 1 and FIG. 2, the insulation member 10 consists of the two oppositely disposed second insulators 13 and the first insulator 12. The first insulator 12 and the second insulators 13 are all flat plates. The high voltage part 20 and the low voltage part 30 are respectively disposed on two sides of the first insulator 12, and the two oppositely disposed second insulators 13 are respectively disposed on two ends of the first insulator 12. That is, the two oppositely disposed second insulators 13 and the first insulator 12 enclose a U-shaped cavity which is the first air passage 11. When the ends of the second insulators 13 are connected to the first insulator 12, the two oppositely disposed second insulators 13 and the first insulator 12 enclose the air passage, that is, the first air passage 11. Here, the high voltage part 20 is located in the first air passage 11.

In an embodiment, as shown in FIGS. 11 and 13, when middle portions of the second insulators 13 are connected to the first insulator 12, the two oppositely disposed second insulators 13 and the first insulator 12 enclose two air passages, that is, the first air passage 11 and a second air passage 15. Here, the high voltage part 20 is located in the first air passage 11, and the low voltage part 30 is located in the second air passage 15.

Further, the insulation member 10 further includes a third insulator 14 which is disposed opposite to the first insulator 12 and is connected to both the two second insulators 13. The air passage is formed between the first insulator 12, the two second insulators 13 and the third insulators 14.

In an embodiment, as shown in FIG. 1 to FIG. 6, the insulation member 10 consists of the two oppositely disposed second insulators 13, the first insulator 12, and the third insulator 14. The first insulator 12, the second insulators 13, and the third insulator 14 are all flat plates. The two oppositely disposed second insulators 13 are respectively disposed on two ends of the first insulator 12, and the third insulator 14 is used to connect the two second insulators 13. That is, the two oppositely disposed second insulators 13, the first insulator 12 and the third insulator 14 enclose a cavity with openings on two sides. The cavity is the first air passage 11. The high voltage part 20 is located in the first air passage 11. The connection position of the second insulator 13 where it is connected to the first insulator 12 can be the end portion or the middle portion, and the connection positions or connection methods are not limited in the present disclosure, as long as at least the first air passage 11 can be formed.

In an embodiment, as shown in FIGS. 11 and 13, the insulation member 10 consists of two oppositely disposed second insulators 13, the first insulator 12, and two third insulators 14 and 16. The first insulator 12 is connected to the middle portions of the second insulators 13, and the two third insulators 14 and 16 are respectively connected to two ends of each of the two second insulators 13. Here, two cavities with openings on two sides are formed by the two oppositely disposed second insulators 13, the first insulator 12 and the two third insulators 14 and 16, that is, the first air passage 11 and the second air passage 15. Here, the high voltage part 20 is located in the first air passage 11, and the low voltage part 30 is located in the second air passage 15.

As shown in FIGS. 10 to 14, the insulation member 10 further includes the third insulator 14 which is connected to all of the first insulator 12 and the two second insulators 13.

In an embodiment, the insulation member 10 consists of the two oppositely disposed second insulators 13, the first insulator 12, and the third insulator 14. The first insulator 12, the second insulators 13, and the third insulator 14 are all fiat plates. The two second insulators 13 and the third insulator 14 are respectively connected to three circumferential edges of the first insulator 12. The connection positions of the second insulator 13 and the third insulator 14 where they are connected to the first insulator 12 may be the end portion or the middle portion. That is, either one or two air passages can be formed, and it only needs to ensure that one air passage is provided on the side where the high voltage part 20 is located.

In an embodiment, as shown in FIGS. 10 to 14, the insulation member 10 consists of the two oppositely disposed second insulators 13, the first insulator 12 and the two third insulators 14 and 16. The first insulator 12 is connected to the middle portions of the second insulators 13, the third insulator 14 is connected to the first end of the first insulator 12, and correspondingly, the third insulator 16 is connected to the second end of the first insulator 12. Here, the first air passage 11 and the second air passage 15 are formed in the insulation member 10, and the air in the two air passages flows in opposite directions.

In an embodiment, with the first side of the first insulator 12 as a reference, there is a preset angle between the third insulator 14 or the third insulator 16 and the first insulator 12, and the preset angle is ranged from 90° to 270°.

Figure 9:
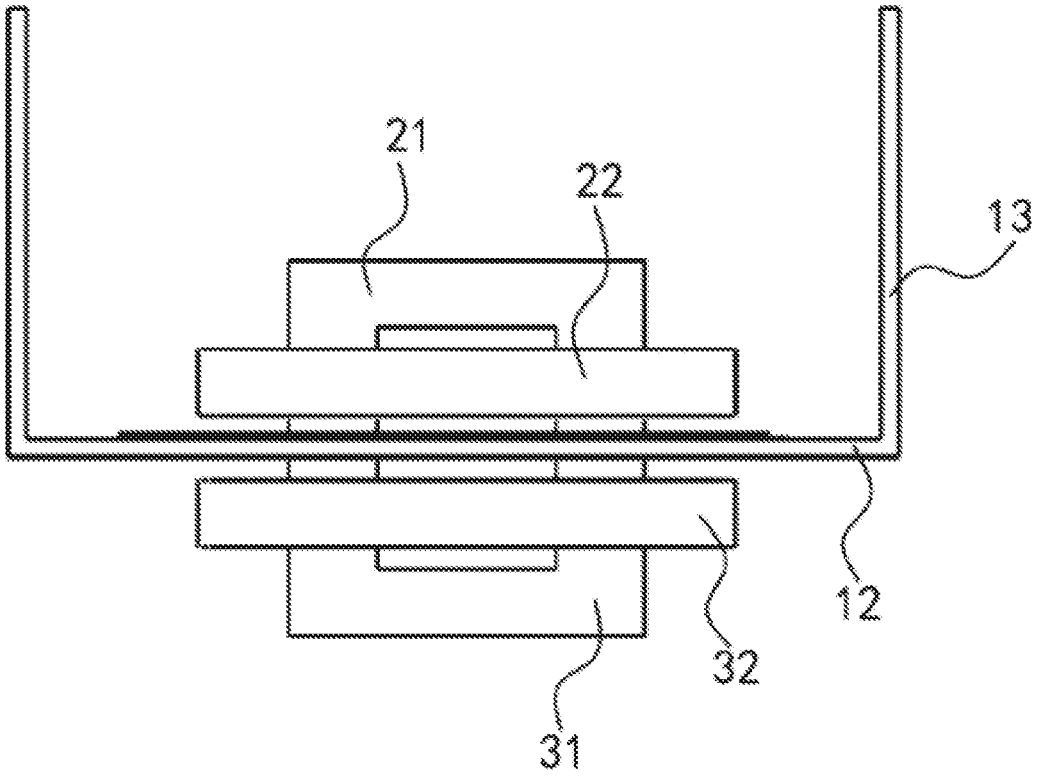
FIG. 9 is a schematic structural diagram showing a transformer from a second perspective according to the fifth exemplary embodiment.
Figure 10:
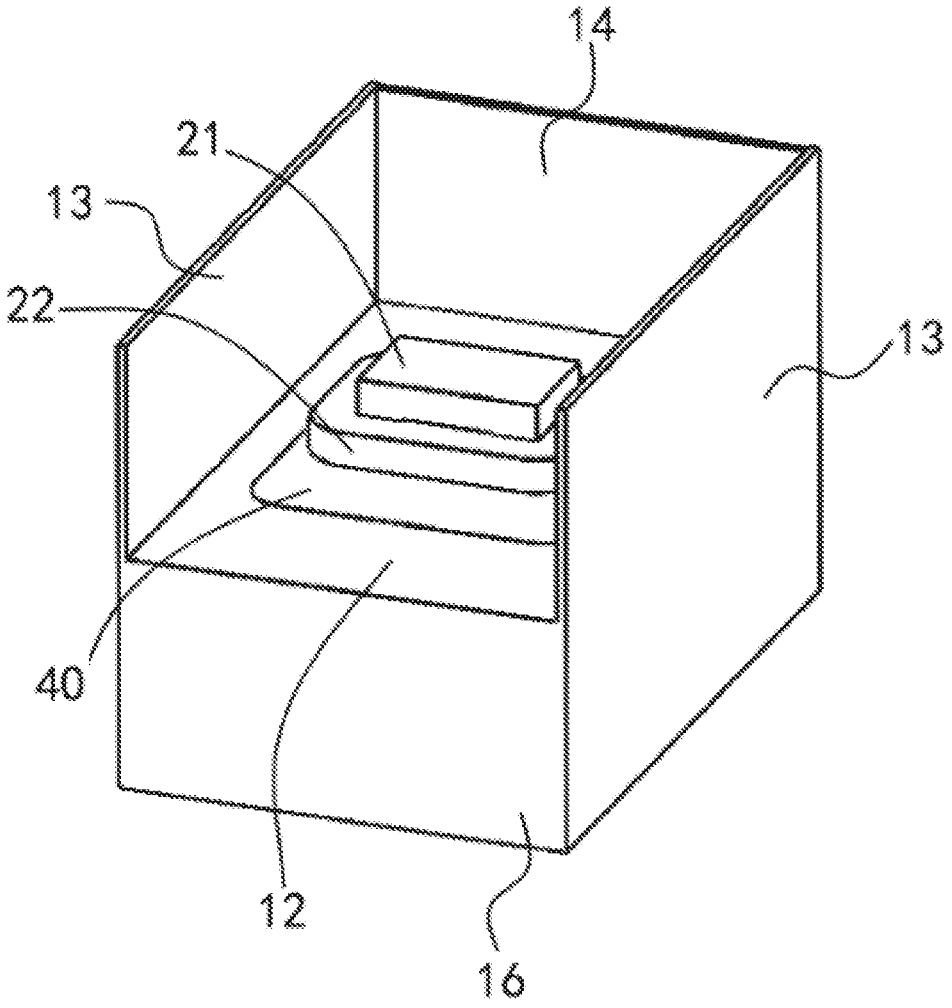
FIG. 10 is a schematic structural diagram showing a transformer according to a sixth exemplary embodiment.

As shown in FIGS. 9 and 10, the preset angle between the third insulator 14 and the first insulator 12 is 90°, and the preset angle between the third insulator 16 and the first insulator 12 is 270°.

Figure 12:
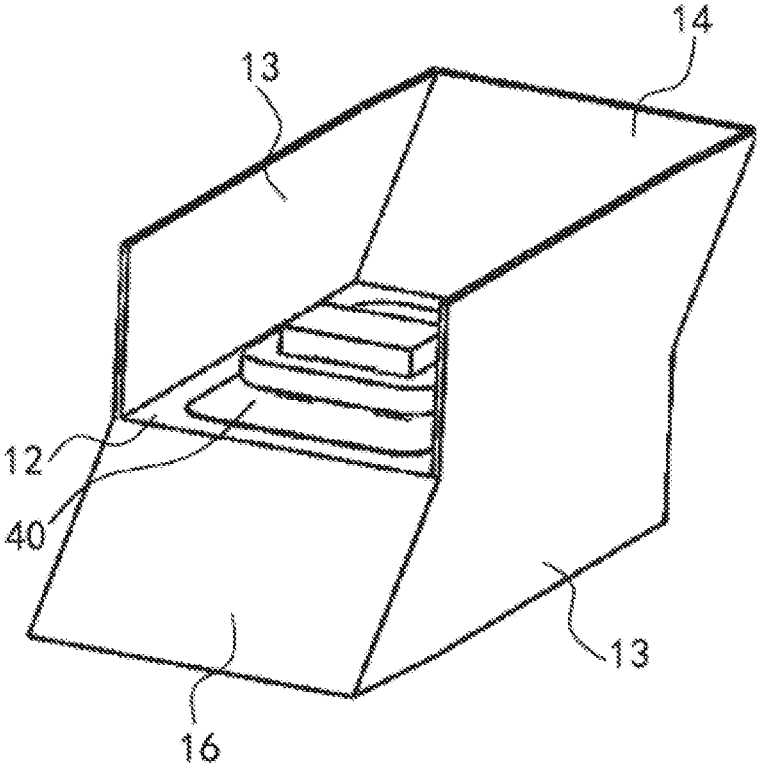
FIG. 12 is a schematic structural diagram showing a transformer according to a seventh exemplary embodiment.
Figure 14:
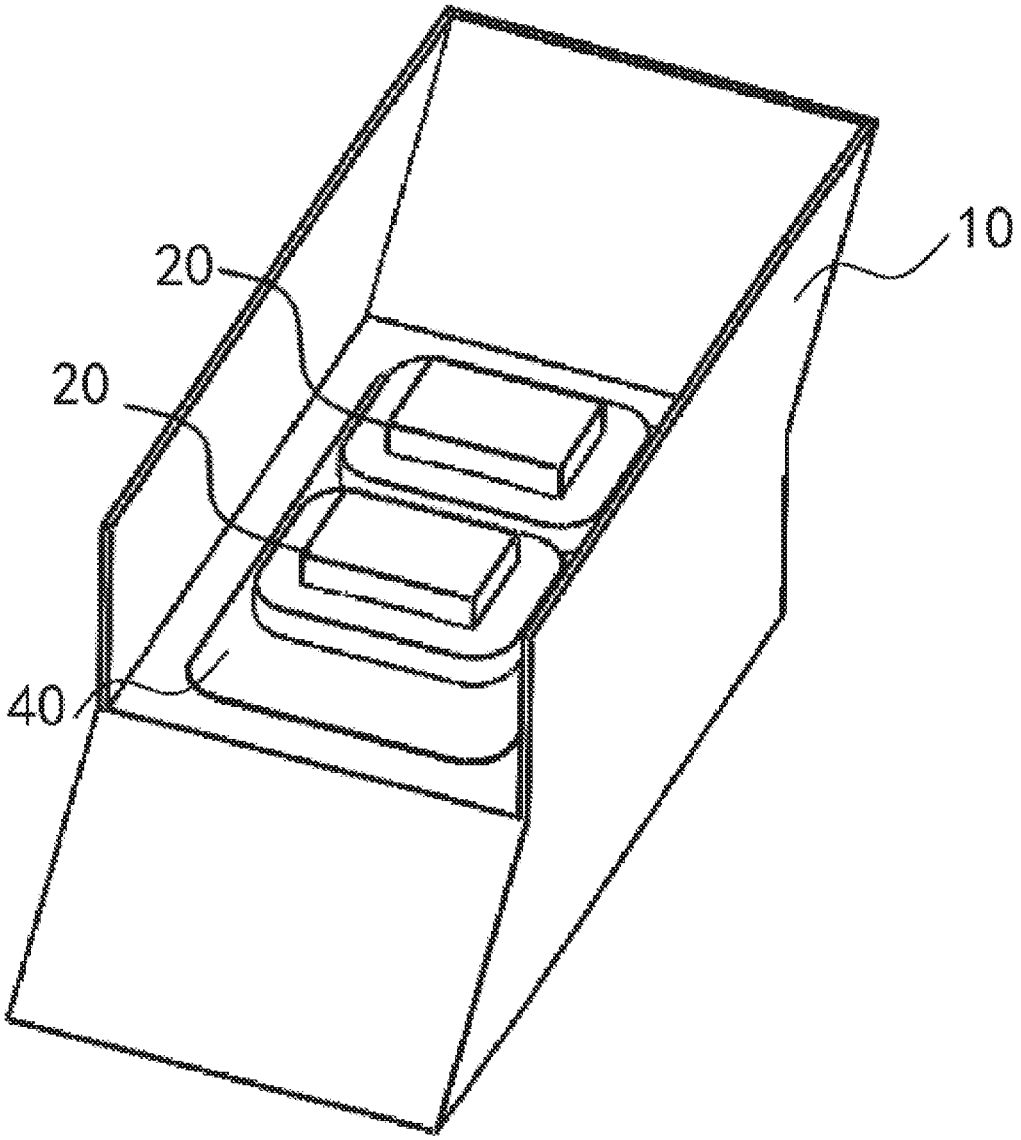
FIG. 14 is a schematic structural diagram showing a transformer according to an eighth exemplary embodiment.

As shown in FIGS. 12 to 14, the preset angle A between the third insulator 14 and the first insulator 12 is an obtuse angle, the preset angle B between the third insulator 16 and the first insulator 12 is an angle greater than 180° and less than 270°. The preset angle A between the third insulator 14 and the first insulator 12 may be 100°, 120°, 140°, or 160°. The preset angle B between the third insulator 16 and the first insulator 12 may be 190°, 210°, 230°, or 250°.

In an embodiment, the third insulator 14 is inclined with respect to the first insulator 12, that is, the third insulator 14 is inclined in an air circulation direction in the air passage, so that windage in the heat dissipation air passage is further reduced.

In an embodiment, the insulation member 10 can include a plurality of insulators which are connected in segments, or can be integrally formed.

In an embodiment, as shown in FIG. 14, there are a plurality of high voltage parts 20 and a plurality of low voltage parts 30, and the plurality of high voltage parts 20 and the plurality of low voltage parts 30 are disposed in one-to-one correspondence.

In an embodiment, the plurality of high voltage parts 20 and the plurality of low voltage parts 30 can be connected to the same circuit. The transformers can be connected in parallel or in series, or can individually isolate the respective separate circuits, which may be flexibly configured according to specific circuit applications.

In an embodiment, the high voltage part 20 includes a first magnetic core 21 and a first winding 22 disposed on the first magnetic core 21, and the low voltage part 30 includes a second magnetic core 31 and a second winding 32 disposed on the second magnetic core 31.

The embodiments of the present disclosure further provide a power module including the above-mentioned transformer, a high voltage power unit, and a low voltage power unit, the high voltage power unit is electrically connected to the high voltage part 20 of the transformer, and the low voltage power unit is electrically connected to the low voltage part 30 of the transformer.

Other embodiments of the present disclosure will be apparent to those skilled in the art in consideration of the specification and practice of the present disclosure disclosed herein. The present application is intended to cover any variations, uses, or adaptations of the present disclosure, which follow the general principles of the present disclosure and include common general knowledge or conventional technical measures in the art that are not disclosed in the present disclosure. The specification and embodiments are merely illustrative, and a true scope and spirit of the present disclosure is defined by the appended claims.

It should be understood that the present disclosure is not limited to the precise structures that have been described above and shown in the drawings, and various modifications and changes can be made without departing from the scope thereof. The scope of the present disclosure is limited only by the appended claims.

What is claimed is:

1. A transformer, comprising:

an insulation member (10), comprising a first insulator (12), a second insulator (13), and a reference plane;

a high voltage part (20), disposed on a first side of the reference plane; and a low voltage part (30), disposed on a second side of the reference plane, wherein, the first insulator (12) is disposed on the reference plane, at least a portion of the second insulator (13) is located around the high voltage part (20), at least one air passage is formed by the insulation member (10), and at least a portion of the air passage is located within a height of the high voltage part (20) in a normal direction of the reference plane, wherein a first conductive part (40) is disposed on the insulation member (10), and is located on the first side of the reference plane, and wherein the first conductive part (40) is made of a semi-conductive material.

2. The transformer according to claim 1, wherein the first conductive part (40) is disposed between the first insulator (12) and the high voltage part (20).

3. The transformer according to claim 2, wherein a projection of the high voltage part (20) on the reference plane is located within a projection of the first conductive part (40) on the reference plane.

4. The transformer according to claim 1, wherein a second conductive part (50) is disposed on the insulation member (10), and is located on the first side of the reference plane, and wherein a conductivity of the second conductive part (50) is lower than that of the first conductive part (40).

5. The transformer according to claim 4, wherein the second conductive part (50) is disposed along a circumferential outer edge of the first conductive part (40).

6. The transformer according to claim 5, wherein the second conductive part (50) is made of a semi-conductive material.

7. The transformer according to claim 5, wherein the second conductive part (50) is made of a metal material.

8. The transformer according to claim 7, wherein at least a portion of the second conductive part (50) is buried in the first insulator (12).

9. The transformer according to claim 1, wherein a third conductive part (60) is disposed on the insulation member (10), and is located on the second side of the reference plane, and wherein the third conductive part (60) is made of a semi-conductive material.

10. The transformer according to claim 9, wherein a fourth conductive part is disposed on the insulation member (10), and is located on the second side of the reference plane, and wherein a conductivity of the fourth conductive part is lower than that of the third conductive part (60).

11. The transformer according to claim 1, wherein the insulation member (10) further comprises:

two second insulators (13) that are oppositely disposed and are connected to two ends of the first insulator (12), respectively, and wherein the air passage is formed between the first insulator (12) and the two second insulators (13).

12. The transformer according to claim 11, wherein the insulation member (10) further comprises a third insulator (14) which is disposed opposite to the first insulator (12) and is connected to both the two second insulators (13), and wherein the air passage is formed between the first insulator (12), the two second insulators (13) and the third insulator (14).

13. The transformer according to claim 11, wherein the insulation member (10) further comprises a third insulator (14) which is connected to the first insulator (12) and the two second insulators (13).

14. The transformer according to claim 13, wherein a preset angle is formed between the third insulator (14) and the first insulator (12), and the preset angle is ranged from 90° to 270°.

15. The transformer according to claim 1, wherein the high voltage part (20) comprises a plurality of high voltage parts (20) and the low voltage part (30) comprises a plurality of low voltage parts (30), and the plurality of high voltage parts (20) and the plurality of low voltage parts (30) are disposed in one-to-one correspondence.

16. The transformer according to 15, wherein the high voltage part (20) comprises a first magnetic core (21) and a first winding (22) disposed on the first magnetic core (21), and the low voltage part (30) comprises a second magnetic core (31) and a second winding (32) disposed on the second magnetic core (31).

17. The transformer according to claim 1, wherein the high voltage part (20) comprises a first magnetic core (21) and a first winding (22) disposed on the first magnetic core (21), and the low voltage part (30) comprises a second magnetic core (31) and a second winding (32) disposed on the second magnetic core (31).

18. A power module, comprising a transformer, a high voltage power unit, and a low voltage power unit, wherein the transformer comprises:

an insulation member (10), comprising a first insulator (12), a second insulator (13), and a reference plane;

a high voltage part (20), disposed on a first side of the reference plane; and a low voltage part (30), disposed on a second side of the reference plane, wherein, the first insulator (12) is disposed on the reference plane, at least a portion of the second insulator (13) is located around the high voltage part (20), at least one air passage is formed by the insulation member (10), and at least a portion of the air passage is located within a height of the high voltage part (20) in a normal direction of the reference plane, and wherein the high voltage power unit is electrically connected to the high voltage part (20) of the transformer, and the low voltage power unit is electrically connected to the low voltage part (30) of the transformer, wherein a first conductive part (40) is disposed on the insulation member (10), and is located on the first side of the reference plane, and wherein the first conductive part (40) is made of a semi-conductive material.

* * * * *